US011712120B2

(12) United States Patent
Burwick et al.

(10) Patent No.: US 11,712,120 B2
(45) Date of Patent: Aug. 1, 2023

(54) LEG PILLOW

(71) Applicant: Bob The Pillow Inc., Williamsville, NY (US)

(72) Inventors: Matthew Burwick, East Amherst, NY (US); Ryan Mills, Clarence, NY (US)

(73) Assignee: Bob The Pillow Inc., Williamsville, NY (US)

( * ) Notice: Subject to any disclaimer, the term of this patent is extended or adjusted under 35 U.S.C. 154(b) by 0 days.

(21) Appl. No.: 17/559,198

(22) Filed: Dec. 22, 2021

(65) Prior Publication Data

US 2022/0240685 A1 Aug. 4, 2022

Related U.S. Application Data

(60) Provisional application No. 63/143,243, filed on Jan. 29, 2021.

(51) Int. Cl.

| | |
|---|---|
| ***A47C 20/02*** | (2006.01) |
| ***A61G 7/075*** | (2006.01) |
| ***A47C 20/00*** | (2006.01) |

(52) U.S. Cl.

CPC ..... *A47C 20/021* (2013.01); *A61G 7/0755* (2013.01); *A47C 20/02* (2013.01); *A61G 7/075* (2013.01)

(58) Field of Classification Search

CPC .... A47C 20/021; A47C 20/02; A61G 7/0755; A61G 7/075; A61G 13/1245; A61G 13/125

USPC ..... 5/648, 624, 621

See application file for complete search history.

(56) References Cited

U.S. PATENT DOCUMENTS

| | | | | | |
|---|---|---|---|---|---|
| 3,124,812 | A * | 3/1964 | Milton et al. | A47G 9/10 | 5/636 |
| 3,604,023 | A * | 9/1971 | Lynch | A61B 6/0442 | D6/601 |
| 4,177,806 | A * | 12/1979 | Griffin | A61F 13/062 | 128/892 |
| 4,688,285 | A * | 8/1987 | Roberts | A61G 7/05723 | 5/630 |
| D319,751 | S * | 9/1991 | Hoff | D6/601 | |
| 5,216,771 | A * | 6/1993 | Hoff | A47C 20/025 | 5/652 |
| 6,154,905 | A * | 12/2000 | Frydman | A47C 20/021 | 606/240 |
| 6,182,314 | B1 * | 2/2001 | Frydman | A47C 20/021 | 606/240 |
| 6,578,218 | B2 * | 6/2003 | Wassilefsky | A61G 7/0755 | 5/640 |
| 6,954,953 | B2 * | 10/2005 | Bordan | A47C 20/021 | 128/882 |
| 7,316,041 | B2 * | 1/2008 | Guez | A47G 9/10 | 5/636 |
| 7,516,504 | B2 * | 4/2009 | Guez | A47G 9/10 | 5/636 |

(Continued)

*Primary Examiner* — Robert G Santos
(74) *Attorney, Agent, or Firm* — Stadler IP Law PLLC

(57) ABSTRACT

A leg pillow having an upper edge and lower edge and two convex curved side edges, wherein a recess is defined in the middle of the leg pillow. The leg pillow also includes leg support indentations at the upper edge. The leg support indentations are on both the top and bottom side of the leg pillow to provide support and proper body alignment for side sleeping individuals.

19 Claims, 4 Drawing Sheets

(56) References Cited

U.S. PATENT DOCUMENTS

| | | | | |
|---|---|---|---|---|
| 8,418,294 | B1 * | 4/2013 | Davis | A47G 9/1009 5/636 |
| 10,842,285 | B1 | 11/2020 | Glass | |
| D930,401 | S * | 9/2021 | Ye | D6/601 |
| 11,497,318 | B1 * | 11/2022 | Smidel | A61G 7/0755 |
| 2001/0027577 | A1 * | 10/2001 | Frydman | A47C 20/021 5/648 |
| 2002/0088057 | A1 * | 7/2002 | Wassilefsky | A61G 7/0755 5/648 |
| 2003/0005521 | A1 * | 1/2003 | Sramek | A47C 20/026 5/648 |
| 2005/0000021 | A1 * | 1/2005 | Bordan | A47C 20/021 5/648 |
| 2005/0273934 | A1 | 12/2005 | Hunter | |
| 2007/0006382 | A1 * | 1/2007 | Guez | A47G 9/10 5/636 |
| 2008/0092296 | A1 * | 4/2008 | Guez | A47G 9/10 5/636 |
| 2008/0092297 | A1 | 4/2008 | Davis | |
| 2014/0026323 | A1 * | 1/2014 | Bowers | A47G 9/109 5/636 |
| 2022/0240685 | A1 * | 8/2022 | Burwick | A47C 20/021 |
| 2022/0338639 | A1 * | 10/2022 | Smidel | A47C 20/021 |
| 2023/0039258 | A1 * | 2/2023 | Smidel | A61G 7/0755 |

* cited by examiner

LEG PILLOW

CROSS-REFERENCE TO RELATED APPLICATIONS

This application claims priority to U.S. Provisional Application having Ser. No. 63/143,243, filed on Jan. 29, 2021, the entire disclosure of which is incorporated herein by reference.

FIELD OF INVENTION

This invention is directed to a pillow. More particularly to a leg pillow to be used to assist in sleeping and orthopedic comfort.

BACKGROUND OF INVENTION

Many individuals sleep on their sides instead of another position. This can be a very comfortable position, but in some cases it may cause, among other things, compression of the spinal cord, pressure on the internal organs and strain on muscles, ligaments, bones, and joints. This sleeping position may also result in prolonged contact between the thighs, knees, and calves, which can lead to an interruption of blood-flow, bruising, and possible cramps. Side sleeping can also cause additional unwanted pressure, impingement and alignment issues on the lumbar spine, thoracic spine, hips, and sacroiliac joints.

If the individual side sleeper already suffers from other health complications, the above problems may be exacerbated. For example, side sleeping may increase the pain for sufferers of arthritis, degeneration, spinal pain, particularly mid and lower back pain, and various knee and hip conditions.

In response to the pain and discomfort caused by side sleeping, many individuals resort to sleeping with an object, such as a pillow, between their legs. This helps restore the proper alignment of the spine, hips, thighs, calves, and ankles, and can help relieve discomfort. A standard pillow shape has drawbacks in that it isn't designed for use between an individual's legs, so it isn't anatomically correct and doesn't provide adequate support for restoring proper alignment.

There have been many attempts to design a pillow that is specifically for use by side sleepers. Many of these leg pillow have shortcomings such as complicated design that requires the need for straps and other fasteners as well as not being properly sized for a full range of motion. There are also storage issues with these leg pillows as they can be very large and/or don't look attractive on a bed.

Thus, there is a need for a leg pillow that provides adequate support to restore proper body alignment and that is simple to use and does not require the use of straps and fasteners.

SUMMARY OF THE INVENTION

Accordingly, it is the subject of this invention to provide an efficiently-sized leg pillow that is simple to use and provides proper body alignment for side sleepers without the use of straps and fasteners.

In one embodiment, a leg pillow is provided including: a body of resilient material, the body having a bottom side, a top side, an upper edge, a lower edge, a first side edge, a second side edge, a recess defined by an upper interior edge, a lower interior edge, a first side interior edge, and a second side interior edge, wherein the upper interior edge is longer than the lower interior edge; a leg support indentation located on the top side between the upper edge and the upper interior edge and defined by a first leg support indentation side wall and a second leg support indentation side wall; a bottom leg support indentation located on the bottom side between between the upper edge and the upper interior edge and defined by a bottom first leg support indentation side wall and a bottom second leg support indentation side wall; and an upper portion and a lower portion and wherein the upper portion is approximately one third of the body and the lower portion is approximately two thirds of the body and wherein the upper portion includes a first raised portion on one side of the leg support indentation and a second raised portion on the other side of the leg support indentation and wherein the upper portion also includes a bottom first raised portion on one side of the bottom the leg support indentation and a bottom second raised portion on the other side of the bottom leg support indentation.

DETAILED DESCRIPTION OF THE INVENTION

Components List

Leg pillow—10
Bottom side—12
Top side—14
Upper edge—16
Lower edge—18
First and second side edges—20, 22
Recessed space—24
Upper interior edge—26
Lower interior edge—28
First and second side interior edges—30, 32
Leg support indentation—34
First and second leg support indentation side walls 36, 38
Bottom leg support indentation—34*a*
Bottom first and second leg support indentation side walls 36*a*, 38*a*
Upper portion—17
Lower portion—19
Middle seam—40
First raised portion—42
Second raised portion—44
Bottom first raised portion—42*a*
Bottom second raised portion—44*a*
Top seam—46
Bottom seam—48
Top raised portion wall—50
Bottom raised portion wall—50*a*
Leg pillow user—100
Thigh—102
Knees—104
Ankles—106
First leg position—110*a*
Second leg position—110*b*
Third leg position—110*c*
$h_1$—height of upper portion
$h_2$—height of lower portion In one embodiment, the leg pillow of the present invention is double sided and allows each leg to bend independently of each other, thereby providing full range of motion for the legs while being fully supported.

Figure 1:
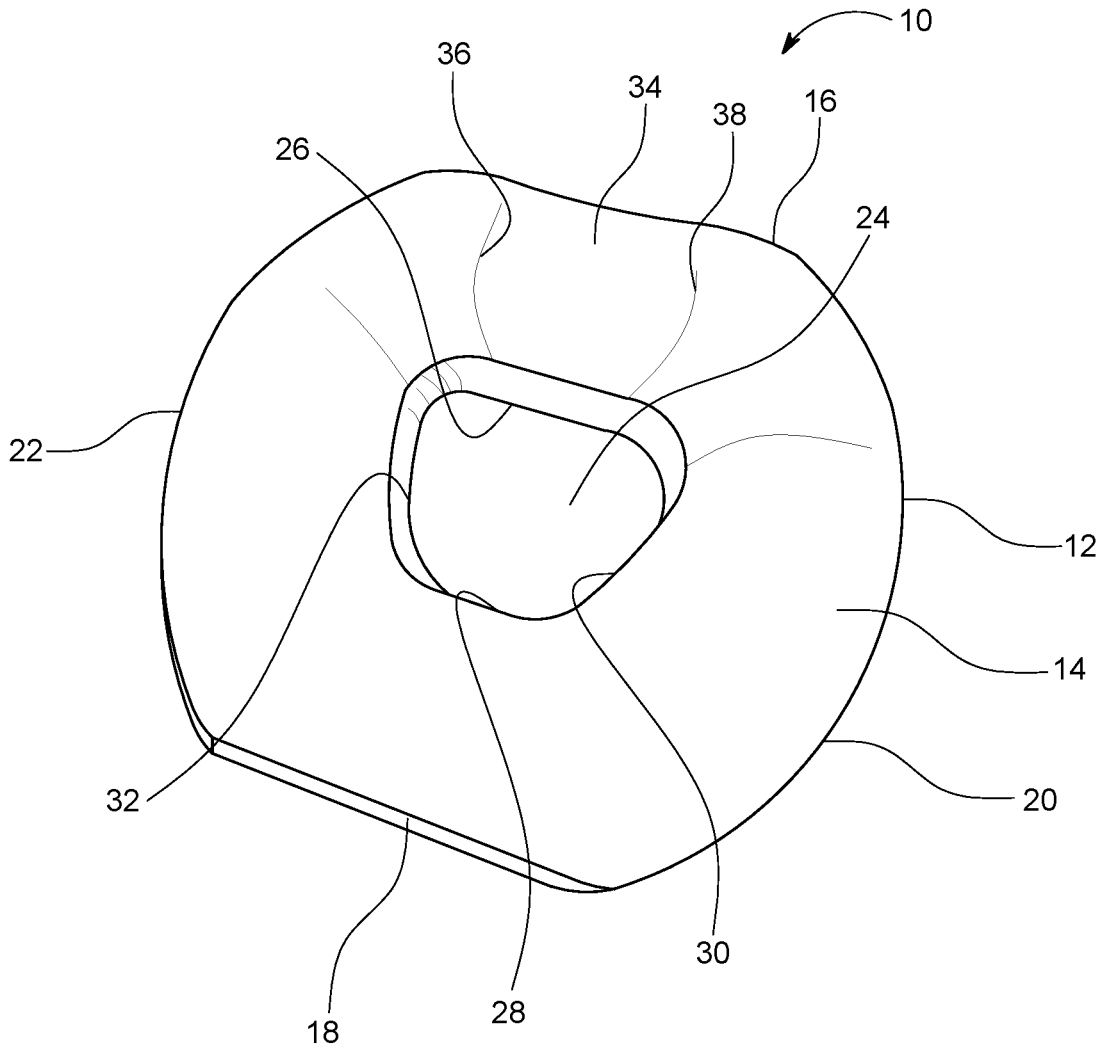
FIG. 1 depicts a top view of a leg pillow.

As can be seen in FIG. 1, leg pillow 10 includes a body of resilient material having a bottom side 12 and a top side 14. It is noted that top side 12 and bottom side 14 are identical, but mirror images. Leg pillow 10 also includes upper edge 16 and lower edge 18, both of which are straight. Leg pillow 10 further comprises first and second side edges 20, 22, which are both convex curved from upper edge 16 to lower edge 18. The upper edge 16, lower edge 18, and first and second side edges 20, 22, are all straight from top side 14 to bottom side 12.

Leg pillow 10 also has a recessed space 24, which is defined by upper interior edge 26, lower interior edge 28, and first and second side interior edges 30, 32. Upper interior edge 26 and lower interior edge 28 are straight across, but are convex curved from the top side 14 to the bottom side 12. Side interior edges 30, 32, are also convex curved from the top side 14 to the bottom side 12 and are wider at the section that starts from the upper interior edge 26 than at the section that ends at the lower interior edge 28. It is noted that in some embodiments, first and second side interior edges 30, 32, upper interior edge 26, and lower interior edge 28, are not convex curved from top side 14 to bottom side 12 and may be straight.

It is noted that while the edges and sides have been described as convex or straight, in other embodiments, the edges and sides may be different than described in the preferred embodiments. In particular, an edge or side that was described as convex may be straight. An edge or side that was described as straight may be convex.

Figure 4:
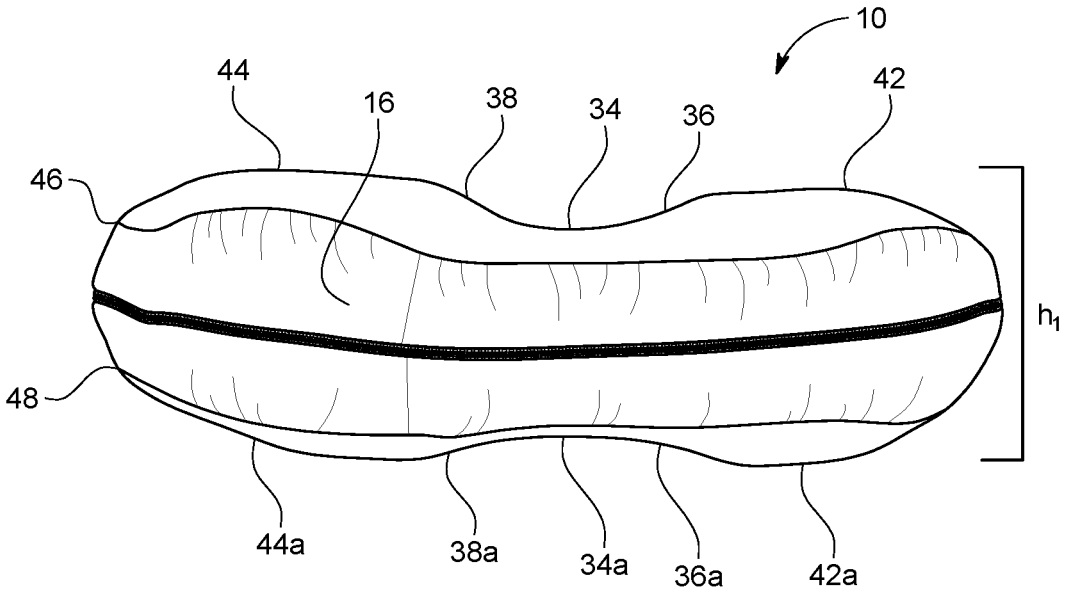
FIG. 4 depicts another side view of a leg pillow.

Leg pillow 10 also includes leg support indentation 34, which is located between upper edge 16 and upper interior edge 26. There is a leg support indentation 34, 34*a*, (FIG. 4) on both the top side 14 and bottom side 12 of leg pillow 10. The leg support indentations 34, 34*a*, are concave with respect to the side of the pillow that they are located. That is, bottom leg support indentation 34*a* is on the bottom side 12 and is concave with respect to the bottom side 12. Leg support indentation 34 is flush with upper edge 16 and upper interior edge 26. It also has first and second leg support indentation side walls 36, 38, which provide the concave indentation with respect to the top side 14. Leg support indentation 34*a* has bottom first and second leg support indentation side walls 36*a*, 38*a*, which provide the concave indentation with respect to the bottom side 12. In one embodiment, first and second leg support indentation side walls 36, 38, are convex curved from first raised portion 42 and second raised portion 44 (FIG. 4). In the same embodiment, bottom first and second leg support indentation side walls 36*a*, 38*a*, are convex curved from bottom first raised portion 42*a* and bottom second raised portion 44*a*.

In a preferred embodiment, the leg pillow 10 is made of high density memory foam. In this embodiment, leg pillow 10 weighs approximately four pounds and the design of leg pillow 10 provides an anti-tilt mechanism, which prevents leg pillow 10 from flipping and forcing the user on his or her stomach during the sleep process. High density memory foam allows the leg pillow 10 to be molded to any particular user. In other embodiments, the leg pillow 10 may be made of any suitable material or components. In some embodiments, the leg pillow 10 may have an inflatable core and have a foam outer layer.

Benefits of the leg pillow 10 include the ability to bend the legs independently of each other, which allows for independent leg motion and a full range of motion while providing continuous leg support. Recessed space 24 allows for air circulation. Leg support indentations 34, 34*a*, allow leg pillow 10 to hold the legs securely in place.

Figure 2:
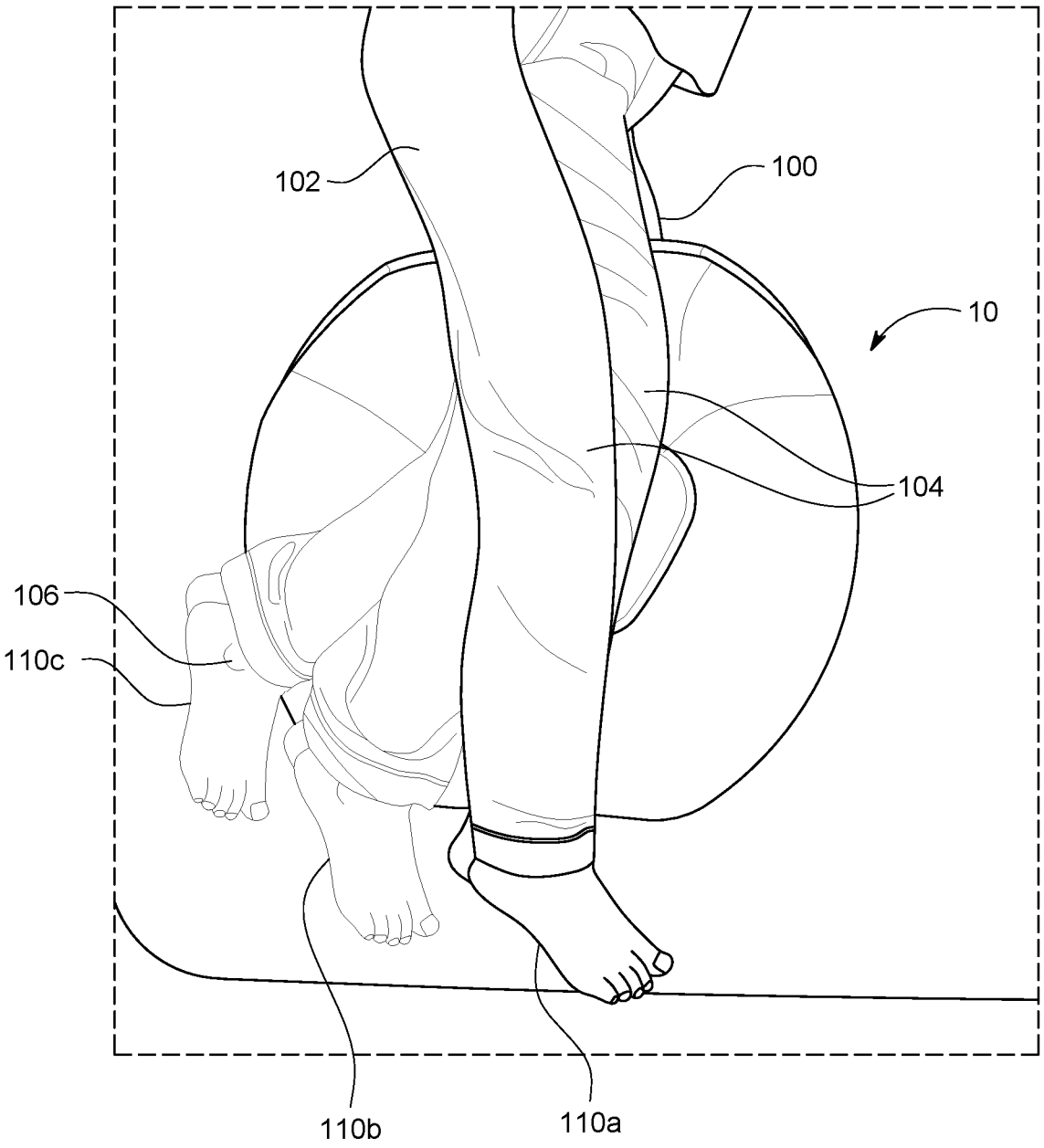
FIG. 2 depicts a top view of a leg pillow in use.

In use, leg pillow 10 may be placed between the thighs 102 or the knees 104 wherein the leg support indentation 34 and bottom leg support indentation 34*a* support the thighs 102 or knees 104 and the ankles 106 are supported by the lower edge 18 or lower portion 19. Leg pillow 10 may be utilized while an individual is lying on their side or back. This is shown in FIG. 2, wherein leg pillow user 100 is depicted in three different leg positions. First leg position 110*a*, having the knees 104 substantially straight. Second leg position 110*b*, having the knees 104 slightly bent. Third leg position 110*c*, wherein the knees 104 are at approximately a 45 degree angle. As can be imagined, there are more leg positions than those depicted in FIG. 2. The knees 104 may be at any angle that the body of leg pillow user 100 allows. The thighs 102 of leg pillow user 100 may also be completely straight or at a slight angle. Because there is a leg support indentation 34 and a bottom leg support indentation 34*a*, the user's 100 two thighs 102 and two knees 104 may be at different angles from one another.

Figure 3:
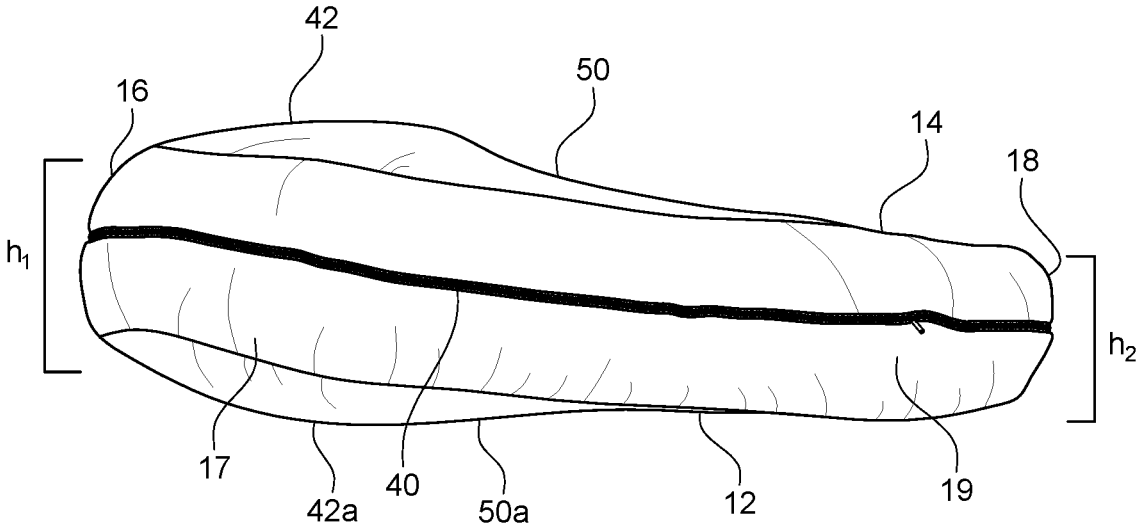
FIG. 3 depicts a side view of a leg pillow.

FIG. 3 is a side view of leg pillow 10 wherein upper edge 16 is depicted to the left and lower edge 18 is depicted to the right. Also shown are upper portion 17 and lower portion 19 both having different heights $h_1$, $h_2$ respectively. In a preferred embodiment, $h_1$ is larger than $h_2$. In one embodiment, upper portion 17 is approximately one third of the leg pillow 10 and lower portion 19 is approximately ⅔ of the leg pillow 10.

As best seen in FIG. 4, upper portion 17 also includes first and second raised portions 42, 44. FIG. 4 depicts a side view of top edge 16 of leg pillow 10. First and second raised portions 42, 44, are on either side of leg support indentation 34. Leg pillow 10 also includes bottom first raised portion 42*a* and bottom second raised portion 44*a*.

As shown in FIG. 3, first raised portion 42 is formed by first raised portion wall 50 which slopes upward from lower portion 19 to upper portion 17. Bottom first raised portion 42*a* is formed by bottom first raised portion wall 50*a* which slopes downward from lower portion 19 to upper portion 17. Although not shown, there is also a second raised portion wall and a bottom second raised portion wall for forming second raised portion 44 and bottom second raised portion 44*a*. The second raised portion wall and bottom second raised portion wall are identical to first raised portion wall 50 and bottom first raised portion wall 50*a* respectively.

In one embodiment, leg pillow 10 has middle seam 40, which can include a zipper to remove a cover. Also included are top seam 46 and bottom seam 48.

In another embodiment, an additional pillow or insert may be placed inside recessed space 24, thereby forming a full pillow with no recessed spaces.

It will be appreciated by those skilled in the art that while the leg pillow has been described in detail herein, the invention is not necessarily so limited and other examples, embodiments, uses, modifications, and departures from the embodiments, examples, uses, and modifications may be made without departing from the process and all such embodiments are intended to be within the scope and spirit of the appended claims.

What is claimed is:

1. A leg pillow comprising:

a body of resilient material, the body having a bottom side, a top side, a straight upper edge, a straight lower edge, a first side edge, a second side edge, a recess defined by an upper interior edge, a lower interior edge, wherein the upper interior edge is longer than the lower interior edge, a first side interior edge, and a second side interior edge;

a leg support indentation located on the top side between the straight upper edge and the upper interior edge and defined by a first leg support indentation side wall and a second leg support indentation side wall; and, a bottom leg support indentation located on the bottom side between the straight upper edge and the upper interior edge and defined by a first bottom leg support indentation side wall and a second bottom leg support indentation side wall.

2. The leg pillow of claim 1 wherein the body is made of high density memory foam.

3. The leg pillow of claim 1 wherein the height of the straight upper edge is larger than the height of the straight lower edge.

4. The leg pillow of claim 3 wherein the body further comprises an upper portion and a lower portion and wherein the upper portion is approximately one third of the body and the lower portion is approximately two thirds of the body.

5. The leg pillow of claim 4 wherein the upper portion includes a first raised portion on one side of the leg support indentation and a second raised portion on the other side of the leg support indentation.

6. The leg pillow of claim 5 wherein the upper portion includes a bottom first raised portion on one side of the bottom leg support indentation and a bottom second raised portion on the other side of the bottom leg support indentation.

7. The leg pillow of claim 6 wherein the leg support indentation is concave from the first raised portion to the second raised portion and the bottom leg support indentation is concave from the bottom first raised portion to the bottom second raised portion.

8. The leg pillow of claim 1 wherein the first side edge and the second side edge are convex curved from the straight upper edge to the straight lower edge.

9. A leg pillow comprising:

a body of resilient material, the body having a bottom side, a top side, a straight upper edge, a straight lower edge, a first side edge, a second side edge, a recess defined by an upper interior edge, a lower interior edge, a first side interior edge, and a second side interior edge, wherein the upper interior edge is longer than the lower interior edge;

a leg support indentation located on the top side between the straight upper edge and the upper interior edge and defined by a first leg support indentation side wall and a second leg support indentation side wall;

a bottom leg support indentation located on the bottom side between between the straight upper edge and the upper interior edge and defined by a bottom first leg support indentation side wall and a bottom second leg support indentation side wall; and an upper portion and a lower portion and wherein the upper portion is approximately one third of the body and the lower portion is approximately two thirds of the body and wherein the upper portion includes a first raised portion on one side of the leg support indentation and a second raised portion on the other side of the leg support indentation and wherein the upper portion also includes a bottom first raised portion on one side of the bottom leg support indentation and a bottom second raised portion on the other side of the bottom leg support indentation.

10. The leg pillow of claim 9 wherein the body is made of high density memory foam.

11. The leg pillow of claim 10 wherein the height of the straight upper edge is larger than the height of the straight lower edge.

12. The leg pillow of claim 11 wherein the first side edge and the second side edge are convex curved from the straight upper edge.

13. The leg pillow of claim 12 wherein the leg support indentation is concave from the first raised portion to the second raised portion and the bottom leg support indentation is concave from the bottom first raised portion to the bottom second raised portion.

14. A leg pillow comprising:

a body of resilient material, the body having a bottom side, a top side, a straight upper edge, a straight lower edge, a first side edge, a second side edge, a recess defined by an upper interior edge, a lower interior edge, a first side interior edge, and a second side interior edge;

a leg support indentation located on the top side between the straight upper edge and the upper interior edge and defined by a first leg support indentation side wall and a second leg support indentation side wall;

a bottom leg support indentation located on the bottom side between the straight upper edge and the upper interior edge and defined by a bottom first leg support indentation side wall and a bottom second leg support indentation side wall; and an upper portion and a lower portion and wherein the upper portion is approximately one third of the body and the lower portion is approximately two thirds of the body and wherein the upper portion includes a first raised portion on one side of the leg support indentation and a second raised portion on the other side of the leg support indentation and wherein the upper portion also includes a bottom first raised portion on one side of the bottom leg support indentation and a bottom second raised portion on the other side of the bottom leg support indentation.

15. The leg pillow of claim 14 wherein the body is made of high density memory foam.

16. The leg pillow of claim 15 wherein the height of the straight upper edge is larger than the height of the straight lower edge.

17. The leg pillow of claim 16 wherein the first side edge and the second side edge are convex curved from the straight upper edge.

18. The leg pillow of claim 17 wherein the leg support indentation is concave from the first raised portion to the second raised potion and the bottom leg support indentation is concave from the bottom first raised portion to the bottom second raised portion.

19. The leg pillow of claim 18 wherein the upper interior edge is longer than the lower interior edge.

* * * * *